US011808030B1

(12) United States Patent
McPherson

(10) Patent No.: US 11,808,030 B1
(45) Date of Patent: Nov. 7, 2023

(54) BLOCKER FOR DRAINAGE TILE

(71) Applicant: Kevin McPherson, Edwardsville, IL (US)

(72) Inventor: Kevin McPherson, Edwardsville, IL (US)

( * ) Notice: Subject to any disclaimer, the term of this patent is extended or adjusted under 35 U.S.C. 154(b) by 0 days.

(21) Appl. No.: 17/574,230

(22) Filed: Jan. 12, 2022

Related U.S. Application Data

(60) Provisional application No. 63/136,534, filed on Jan. 12, 2021.

(51) Int. Cl.
*E04B 1/70* (2006.01)

(52) U.S. Cl.
CPC ..... *E04B 1/70* (2013.01)

(58) Field of Classification Search
CPC ..... E04B 1/70; E04B 1/7023; E04B 1/703; E04B 1/7038; E04B 200/5322; E02D 31/02; E02D 31/06
USPC ..... 52/169.5, 169.14, 302.3
See application file for complete search history.

(56) References Cited

U.S. PATENT DOCUMENTS 3,979,860 A * 9/1976 Roth ..... E04D 13/1415 52/302.1
4,075,800 A * 2/1978 Molick ..... E04B 1/6803 52/302.3
4,333,281 A * 6/1982 Scarfone ..... E04B 1/7023 52/302.3
4,745,716 A * 5/1988 Kuypers ..... E04F 17/00 52/302.3
5,044,821 A * 9/1991 Johnsen ..... E02D 31/02 52/169.5
D329,297 S * 9/1992 Smith ..... D25/138
5,694,723 A * 12/1997 Parker ..... E02D 27/32 404/4
5,749,182 A * 5/1998 Vavrinak ..... E02D 31/02 52/58
5,775,039 A * 7/1998 McPherson ..... E04B 1/7023 52/746.1
5,794,388 A * 8/1998 Jackman ..... E04B 1/7023 52/302.1
6,182,412 B1 * 2/2001 Traxler ..... E04B 1/72 43/132.1
6,230,468 B1 * 5/2001 Klaus ..... E02D 31/06 52/287.1
6,238,766 B1 * 5/2001 Massett ..... E02D 31/02 428/101
6,672,016 B2 * 1/2004 Janesky ..... E02D 31/06 405/38
6,691,472 B2 * 2/2004 Hubert ..... E02D 31/02 52/408
6,964,136 B2 * 11/2005 Collins ..... E04B 1/70 52/302.1
7,810,291 B2 * 10/2010 McPherson ..... E04B 1/7023 52/302.1
7,918,055 B2 * 4/2011 Cotten ..... E04B 1/7023 52/302.3

(Continued)

*Primary Examiner* — James M Ference
(74) *Attorney, Agent, or Firm* — Stinson LLP

(57) ABSTRACT

A drainage tile system includes a drainage tile and a blocker configured for mounting on the drainage tile. The drainage tile is configured to be used on a footing of a foundation to promote drainage of water along the footing and away from a foundation wall. The blocker is configured to attach to the wall member and to cover a gap between the wall member and the foundation wall.

13 Claims, 8 Drawing Sheets

(56) References Cited

U.S. PATENT DOCUMENTS

| | | | | |
|---|---|---|---|---|
| 8,297,005 | B1 * | 10/2012 | Bramble | E02D 31/002 52/302.3 |
| 8,607,525 | B2 * | 12/2013 | Trotter | E04B 1/7023 52/302.6 |
| 9,222,252 | B1 * | 12/2015 | Williams | E04B 1/70 |
| 9,783,980 | B2 * | 10/2017 | Snyder | E04B 1/625 |
| 10,487,472 | B2 * | 11/2019 | McPherson | E02D 31/06 |
| 10,829,904 | B1 * | 11/2020 | McPherson | E04B 1/7023 |
| 10,844,603 | B2 * | 11/2020 | Egan | E04D 5/06 |
| 2002/0014046 | A1 * | 2/2002 | Korn | E04D 13/1415 52/287.1 |
| 2002/0139068 | A1 * | 10/2002 | Janesky | E02D 31/06 52/302.1 |
| 2003/0126810 | A1 * | 7/2003 | Brunson | E04F 17/00 52/302.3 |
| 2005/0055890 | A1 * | 3/2005 | Summy | E06B 1/62 52/58 |
| 2005/0198916 | A1 * | 9/2005 | Janesky | E02D 31/02 52/169.5 |
| 2006/0032158 | A1 * | 2/2006 | Moule | E02D 31/06 52/169.5 |
| 2006/0032163 | A1 * | 2/2006 | Korn | E04B 1/68 52/241 |
| 2006/0137289 | A1 * | 6/2006 | Cotten | E02D 31/02 52/717.02 |
| 2009/0183445 | A1 * | 7/2009 | McPherson | E02D 31/02 52/302.3 |
| 2014/0215931 | A1 * | 8/2014 | Fechino | E04B 1/7038 52/61 |
| 2018/0216309 | A1 * | 8/2018 | McPherson | E04B 1/703 |
| 2020/0063393 | A1 * | 2/2020 | Trebil | E04B 1/7023 |

* cited by examiner

BLOCKER FOR DRAINAGE TILE

BACKGROUND

This invention relates generally to drainage systems and more particularly to drainage devices for use in providing a flow path below basement floors for water seeping in between foundation walls and footing to prevent water leakage onto basement floors.

A problem in many basements is that of wet or damp basement floors caused by water seeping under the foundation wall and flowing up between the foundation wall and the basement floor. It is not practical, or even desirable, to prevent water from seeping under the foundation wall. Water pressure build up behind the wall can damage the wall. Therefore, drainage systems are used to provide a flow path for water entering between the foundation wall and footing to a sump, thus preventing the water from flowing up between the foundation wall and basement floor.

Presently available drainage systems include drainage devices in the form of tiles, over which the basement concrete floor is poured. Prior drainage devices, such as those shown in U.S. Pat. Nos. Des. 329,297 and 4,745,716, have a flat wall member and a plurality of feet extending downward therefrom and engaging the footing to create flow paths for the water between the floor and footing. Drainage tile is typically also applied to the foundation wall adjacent the footing to facilitate entry of water into the flow paths for water along the footing. However, paths provided along the wall can provide access to subterranean gases and insects into the interior of the building.

SUMMARY

In one aspect of the present invention, a drainage tile system generally comprises a drainage tile including a wall member having a footing section configured to rest on a footing of a foundation and to permit water to flow along the footing. A wall member of the drainage tile is configured to face a foundation wall in at least partially spaced relation with the foundation wall thereby defining a gap between the foundation wall and the wall member. The system further includes a blocker configured to attach to the wall member and to cover the gap between the wall member and the foundation wall.

In another aspect of the present invention, a drainage blocker can be used on drainage tile applied to a footing of a foundation to permit water to flow along the footing. The drainage tile includes a wall member configured to face a foundation wall in at least partially spaced relation with the foundation wall thereby defining a gap between the foundation wall and the wall member. The blocker generally comprises a connection portion configured to attach to the wall member and a cap portion projecting from the connection portion. The cap portion is configured to be positioned so that when the blocker is attached to the wall member resting on the footing of the foundation, the cap projects from the wall member to the foundation wall to substantially close a gap between the wall member and the foundation wall.

BRIEF DESCRIPTION OF THE DRAWINGS

Corresponding reference characters indicate corresponding parts throughout the several views of the drawings.

DETAILED DESCRIPTION OF ILLUSTRATED EMBODIMENT

Figure 1:
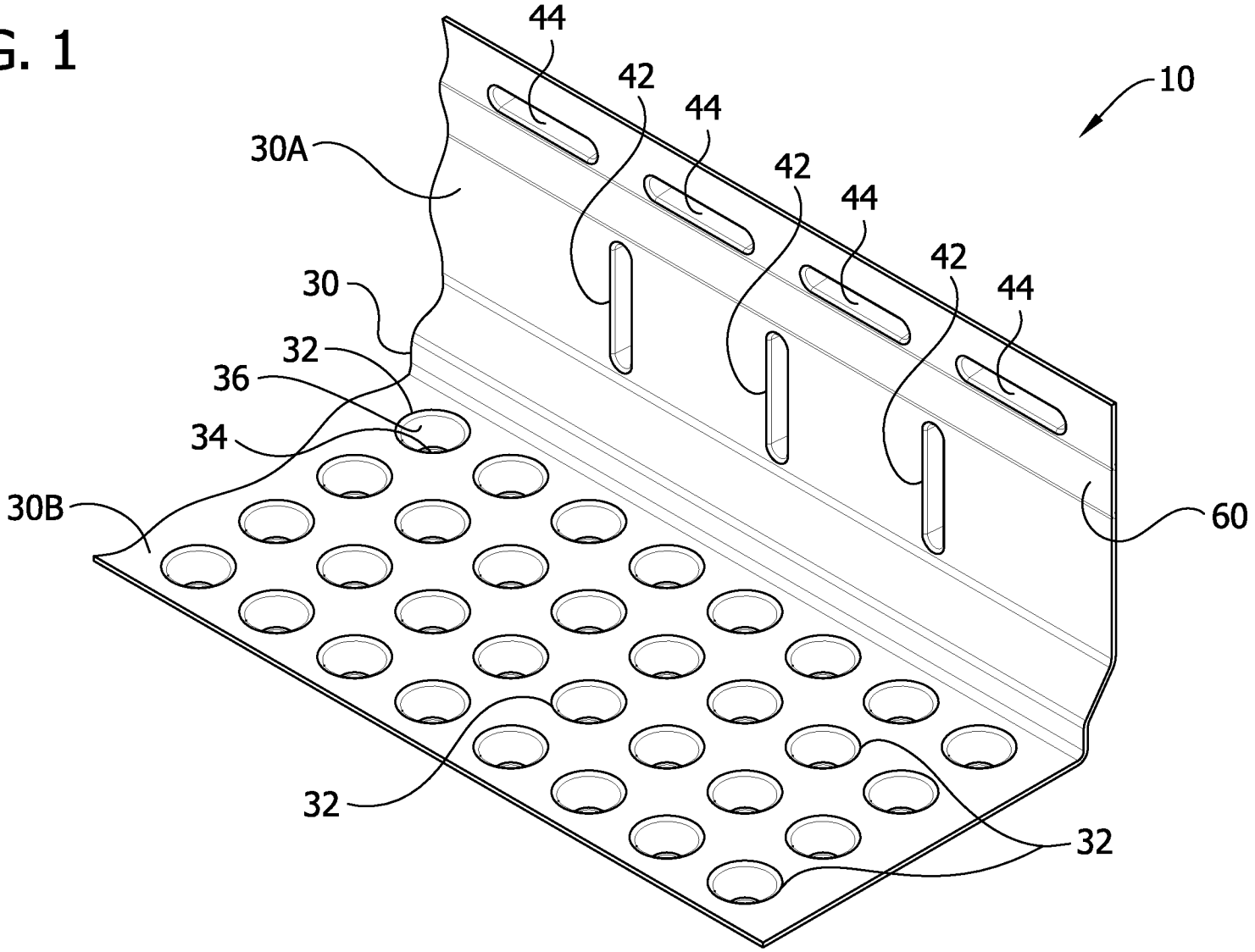
FIG. 1 is a fragmentary perspective of a drainage tile of the present invention.

Referring now to the drawings, and first to FIGS. 1-4, there is generally indicated at 10 a drainage tile of this invention (broadly, "drainage device"). The drainage tile 10 is for use under a floor 12 in a structure (e.g., a residence) including the floor, a foundation wall 14, and a footing 16 located below the foundation wall (see, FIG. 4). A drain or sump (not shown) may be located along the foundation to receive the drained water. The drainage tile 10 is constructed for placement on the footing 16 adjacent to the foundation wall 14 prior to installation of the floor 12 to permit water to flow along the footing under the floor. The structure can be formed in a conventional manner with the footing 16 and foundation wall 14 typically formed of concrete. As will be understood by those of ordinary skill in the art, other materials can be used. For example, cinder blocks (not shown) may be used for the foundation wall. The footing 16 extends around the perimeter of the structure and supports the foundation wall 14. The footing 16 also extends beyond the foundation wall into the interior of the structure for supporting a peripheral edge of the basement floor 12 at the outer perimeter of the floor. The remaining portion of the floor 12 is supported by a layer of gravel and dirt generally indicated at 20. The drainage tile 10 may be used in buildings such as residential houses, commercial buildings, factories or any other building having a similar structural arrangement.

Figure 2:
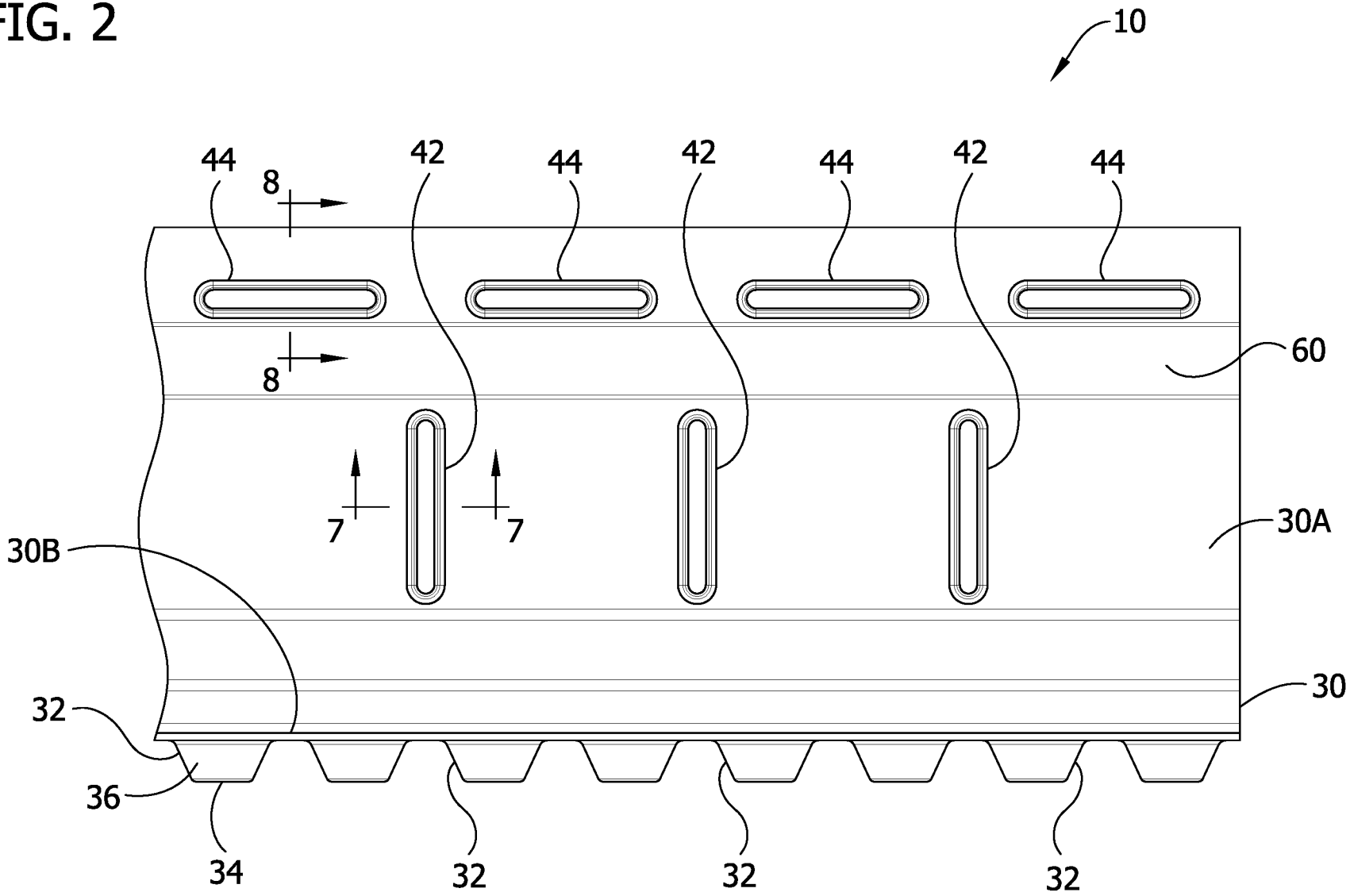
FIG. 2 is a fragmentary front elevation thereof.
Figure 3:
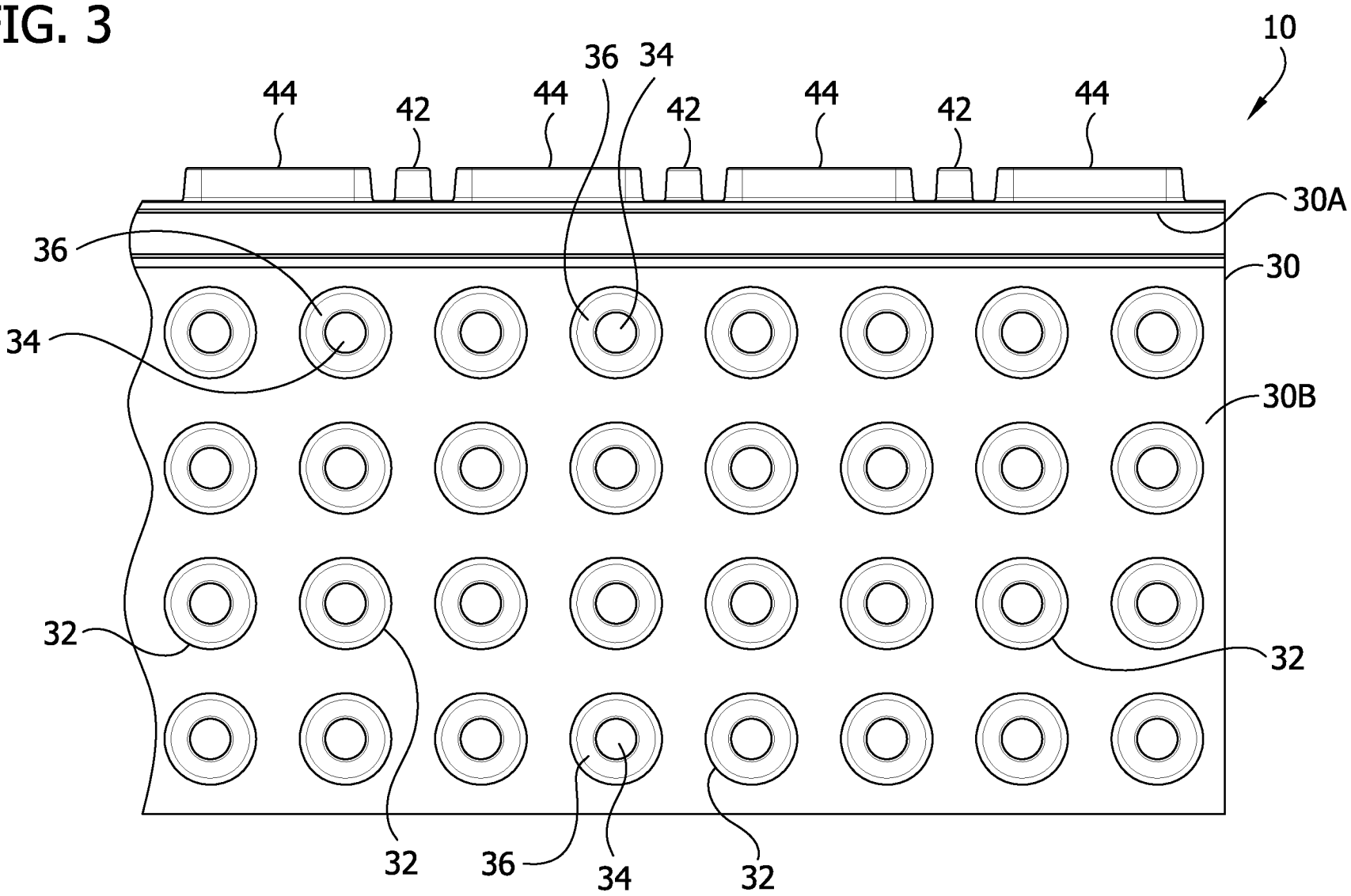
FIG. 3 is a fragmentary top view thereof.
Figure 4:
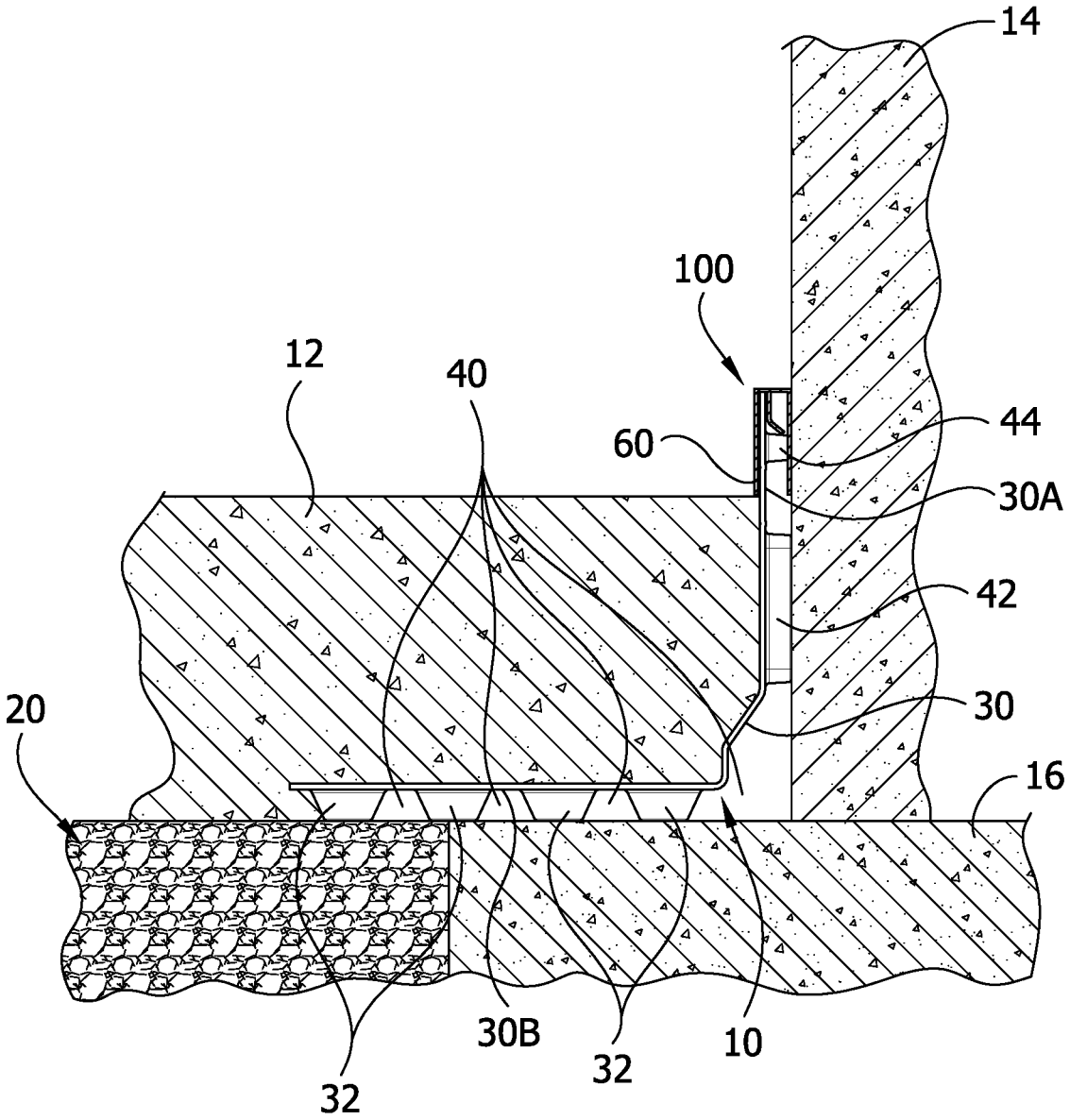
FIG. 4 is a side elevation of the drainage tile as installed on a footing of a foundation of a structure and having a blocker installed thereon.

The drainage tile 10 comprises a wall member 30 including a wall section 30A that is located adjacent to the foundation wall 14, and a footing section 30B that is located generally adjacent to the footing when the drainage tile is placed on the footing. In one embodiment, the angle between the wall section 30A and the footing section 30B is about 115°. Other angles may be used within the scope of the present invention, but there is some advantage to having the angle be greater than 90° so that the wall sections 30A, 30B are deflected from a relaxed condition as installed on the footing 16. A first surface of the wall member 30 faces generally away from the foundation wall 14 and/or footing 16, and a second surface of the wall member faces generally toward the foundation wall and/or footing. The wall member 30 includes protrusions that project outwardly from the second surface of the wall member and open at the first surface. The protrusions include spaced apart feet 32 depending from the footing section 30B of the wall member 30. The wall member 30 is preferably rectangular in shape and has a width greater than the distance from the foundation wall 14 to the end of the footing 16. The feet 32 are hollow and open upwardly through the first surface of the wall member 30 for receiving material poured to form the floor 12 whereby the weight of the floor is supported by the floor material within the feet and not by the wall member. Each foot 32 comprises a bottom wall 34 and a sidewall 36 which is generally frustoconically shaped (although the sidewall may have other shapes such as cylindrical), as can be seen in FIGS. 2 and 4. It is to be understood that the feet 32 may be rectangular or other suitable shapes without departing from the scope of this invention. The bottom walls 34 of the feet 32 are generally parallel with the wall member 30 and are engageable with the footing 16 at spaced apart locations for vertically spacing the wall member from the footing.

The feet 32 define fluid flow channels 40 for water seeping from between the foundation wall 14 and the footing 16 and allow water to flow freely underneath the floor 12 and along the footing, either into the gravel or to the drain. The placement of the feet 32 is such that the flow channels 40 allow water to travel both longitudinally and laterally with respect to each foundation wall 14. The size and number of feet 32 may vary as long as there is enough surface area provided by the feet to allow for adequate support for the wall member 30 upon pouring the floor material over the drainage tiles 10. It is to be understood that the feet 32 may vary in size and spacing without departing from the scope of this invention. The height of the feet 32 should be large enough to provide adequate flow rates through the flow channels 40 so that under worse case conditions the water will be permitted to flow freely without causing pressure to build up due to water entering the structure at a faster rate than it can be removed. The wall member 30 and feet 32 are preferably integrally formed from a thin (e.g., 0.04 in.) single sheet of material (e.g., ptherlate glycol, "PETG" plastic). The drainage tile 10 may be formed from a polymeric material or other suitable material which is impervious to water and strong enough to retain its shape after the concrete floor is poured and until the floor 12 sets. The drainage tile 10 is preferably sized to extend outwardly beyond the footing 16 so that a portion of the drainage tile 10 covers the rock 20 to permit flow of water between the footing and the rock (FIG. 4). The drainage tile 10 may be formed of a material capable of transmitting light in the visual range or may be opaque.

The wall section 30A of the of the wall member 30 also has protrusions in the form of vertical, elongate channels 42 and horizontal, elongate channels 44 spaced along the length of the drainage tile 10. The vertical and horizontal channels 42, 44 constitute "connecting protrusions" in the illustrated embodiment. The use of connecting protrusions to attach adjacent drainage tiles is described in my U.S. Pat. No. 7,810,291, the disclosure of which is incorporated in its entirety herein by reference. However, the construction of the drainage tile may be other than described within the scope of the present invention. In one embodiment, the drainage tile may not have any capability to connect to adjacent drainage tile. In another embodiment, the drainage tile may take a completely different form, such as a dimpled sheet (not shown) that is folded into an L-shape on a foundation to permit water to flow along the foundation under the dimpled sheet and down the wall.

As may be seen in FIG. 4, the vertical and horizontal channels 42, 44 engage the foundation wall 14 and provide a space between the wall and the floor 12. The vertical and horizontal channels 42, 44 also space the remainder of the wall section 30A from the foundation wall 14. Water may flow down the foundation wall 14 and onto the footing 16 where the water may flow to the sump. However, the gap between the foundation wall also provides a pathway for gasses to flow from beneath the floor 12 into the basement space. In areas where potentially harmful gases (e.g. radon) are present underground, this pathway is not desired. Also, insects may enter the structure through this gap.

Figure 5:
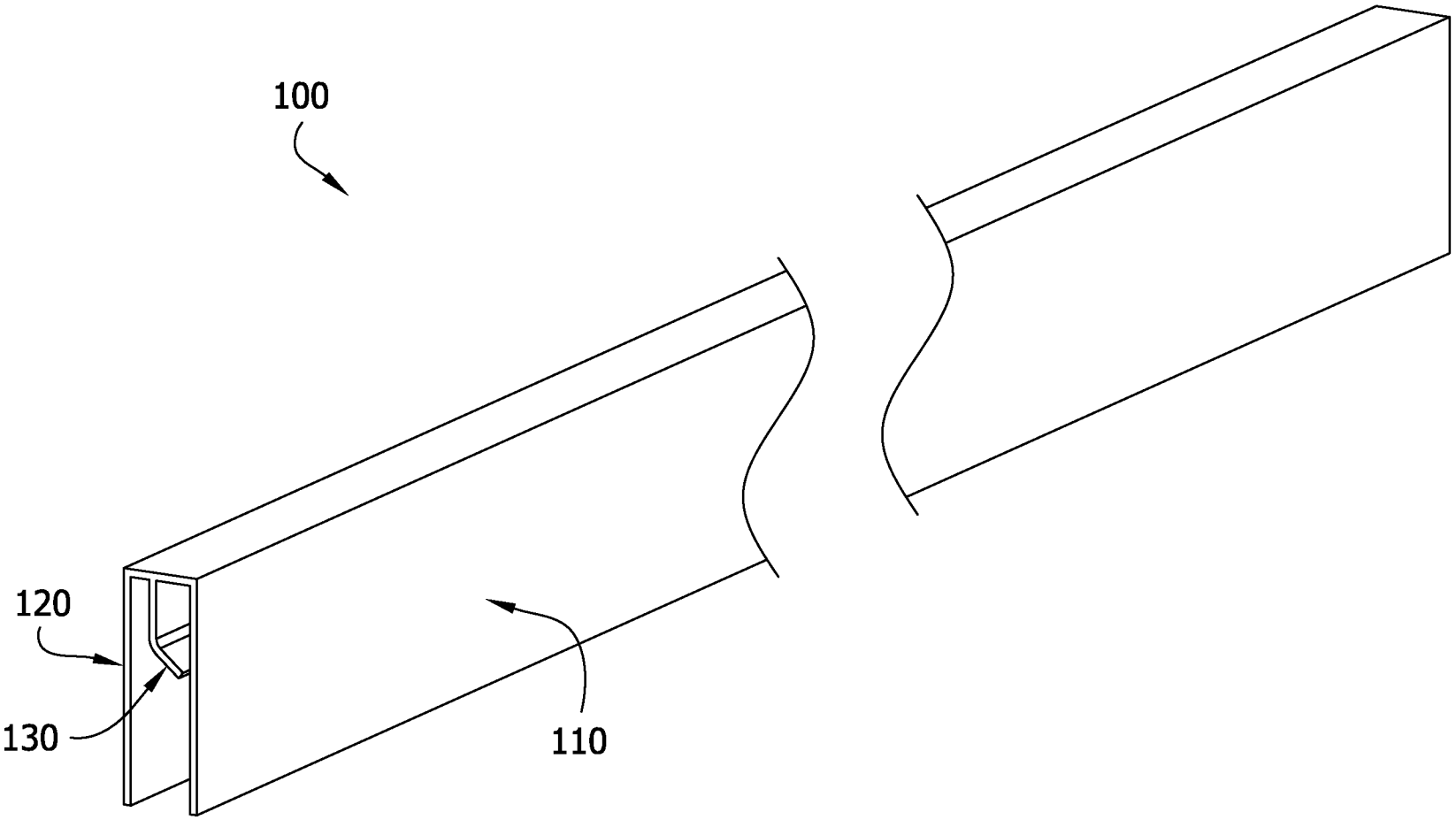
FIG. 5 is a fragmentary perspective of the blocker.
Figure 6:
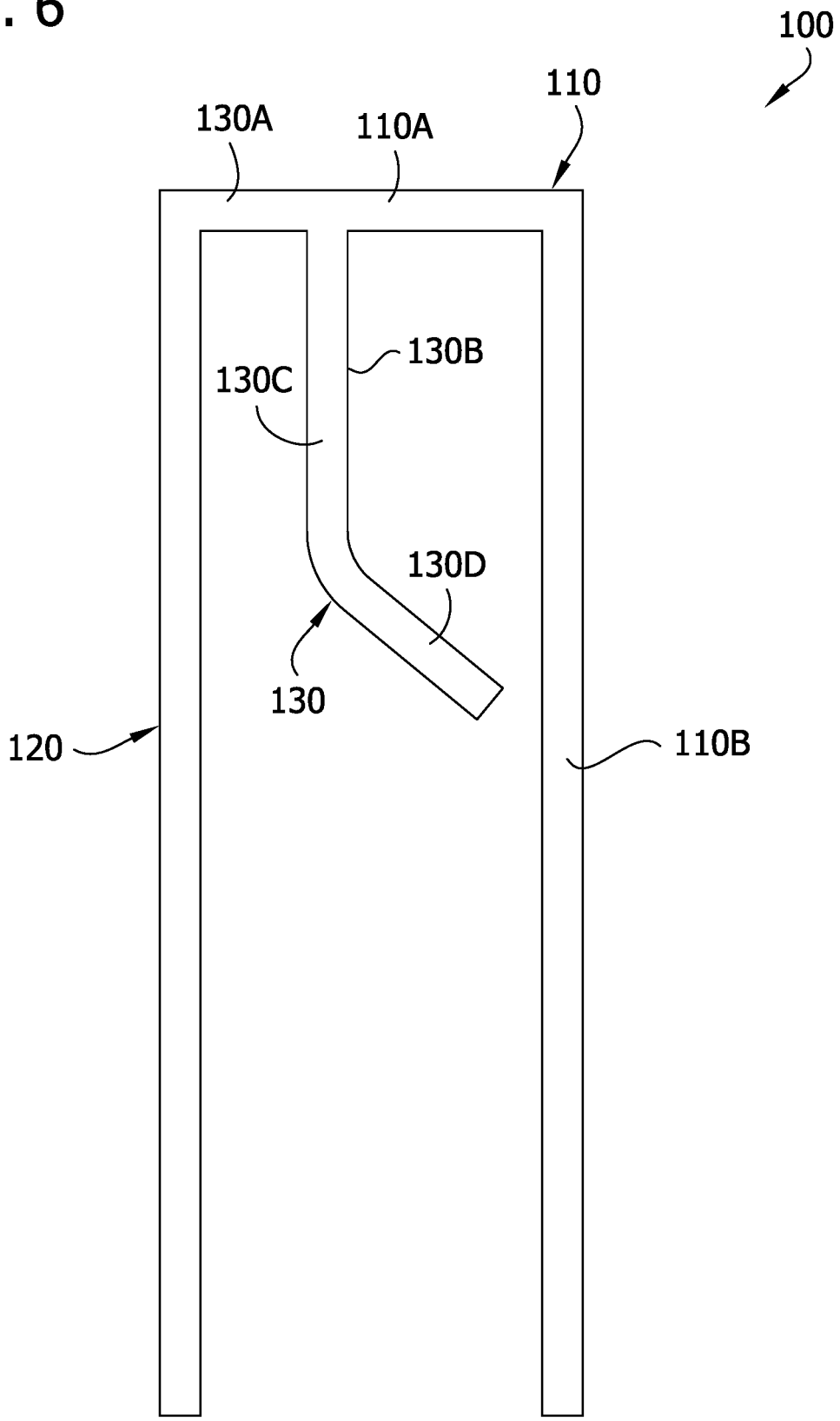
FIG. 6 is an enlarged end view of the blocker.

Referring now to FIGS. 5 and 6, a blocker for use with the drainage tile 10 is designated generally at 100. The blocker includes a cap portion 110, a tile engagement portion 120, and a clip portion 130. In the illustrated embodiments, the tile engagement portion and the clip portion may be considered collectively to be a connection portion. The connection portion is preferably constructed so that it can hold the blocker 100 in a self-retaining position on the drainage tile. The tile engagement portion 120 has a first end and a second end. The cap portion 110 and clip portion 130 each have a first segment and a second segment. The first segment 130A of the clip portion 130 is attached to the first end of the tile engagement portion 120, and the second segment 130B of the clip portion projects in a direction from the first end of the tile engagement portion toward the second end of the tile engagement portion. The first segment 110A of the cap portion 110 is attached to the first segment 130A of the clip portion 130, and the second segment 110B of the cap portion projects in a direction from the first end of the tile engagement portion 120 toward the second end of the tile engagement portion and is generally parallel to the tile engagement portion. The second segment 110B of the cap portion 110 extends the full height of the blocker 100. The tile engagement portion 120 has a height that is about the same as the height of the second segment 110B of the cap portion 110.

The first segment 130A of the clip portion 130 comprises a horizontal member extending from the tile engagement portion 120. The second segment 130B of the clip portion 130 comprises an upper member 130C and a lower member 130D. The upper member 130C extends from the first segment 130A in a vertically downward direction. The lower member 130D extends from a lower end of the upper member 130C at an angle to the upper member, generally away from the tile engagement portion 120. In one embodiment, the lower member 130D makes an angle of about 45° with respect to the upper member 130A. The angled lower member 130D facilitates capturing an upper edge of the wall section 30A of the drainage tile 10 when the blocker 100 is inserted onto the drainage tile. It will be understood that connection of the blocker 100 to the upper edge of the wall section 30A of the drainage tile 10 is a blind mate when the blocker is made of an opaque material. The angled lower member 130D can engage the upper edge of the wall section 30A and guide it into the narrower space between the upper member 130C and the tile engagement portion 120 when the upper edge of the wall section is out of alignment with the space between the upper member and the tile engagement portion.

As shown in FIG. 4, the blocker 100 can be attached to the top of the wall section 30A of the drainage tile 10. The upper edge margin of the wall section 30A is received in the gap between the upper member 130C of the second segment 130B of the clip portion 130 and the interior face of the tile engagement portion 120. The size of the gap is selected in one embodiment to be smaller than the thickness of the material of the wall section 30A so that the clip portion 130 is resiliently deformed by the wall section. The clip portion 130 (and particularly the second upper member 130C of the second segment 130B) bears against and grips the upper edge margin of the wall section 30A for use in holding the blocker 100 on the drainage tile 10. The clip portion 130 does not extend down so far as to engage the horizontal channels 140 of the drainage tile 10. It will be understood that other ways of securing the blocker 100 to the wall member 30 may be used within the scope of the present invention. When the blocker 100 is installed on the drainage tile 10, the second segment 11B of the cap portion 110 abuts the wall 14. In addition to the benefits provided in the '291 patent of permitting the flow of water along the footing 16 under the floor and to a sump, the blocker 100 provides the benefit of forming a cap at the top of the drainage tile 100 with the first segment 110A of the cap portion 110. By spanning the length of the drainage tile 100, the first segment 110A of the cap portion 110 substantially eliminates the gap that could be formed between the wall section 30A and the foundation wall 14 at the upper end of the wall section 30A. The effect of this cap is the reduction of the amount of subterranean gasses, such as radon, and insects entering the house through the gaps in the concrete or the space in between the wall section 30A and the foundation wall 14. The blocker 100 is meant to be used primarily in retrofitting basement floors with the drainage tile 10, but can also be used in new construction projects as well.

In a preferred embodiment of the present invention, the tile engagement portion 120 and the second segment of the cap portion 110 are approximately an inch (1") in height. The first segment 130A of the clip portion 130 is sized so that the opposing faces of the upper member 130C of the second segment 130B of the clip portion and the tile engagement portion 120 is about ⅛". The upper member 130C of the clip portion 130 has a height of about ¼" and the lower member 130D also extends about ¼", although at an angle. The first, horizontal segment 110A of the cap portion 110 extends widthwise of the blocker 100 about 7/16". The blocker 100 has a length about the same as the drainage tile 10 (e.g., about 6 feet). However, the dimensions of any part of the blocker may be different from those described within the scope of the present disclosure.

Figure 7:
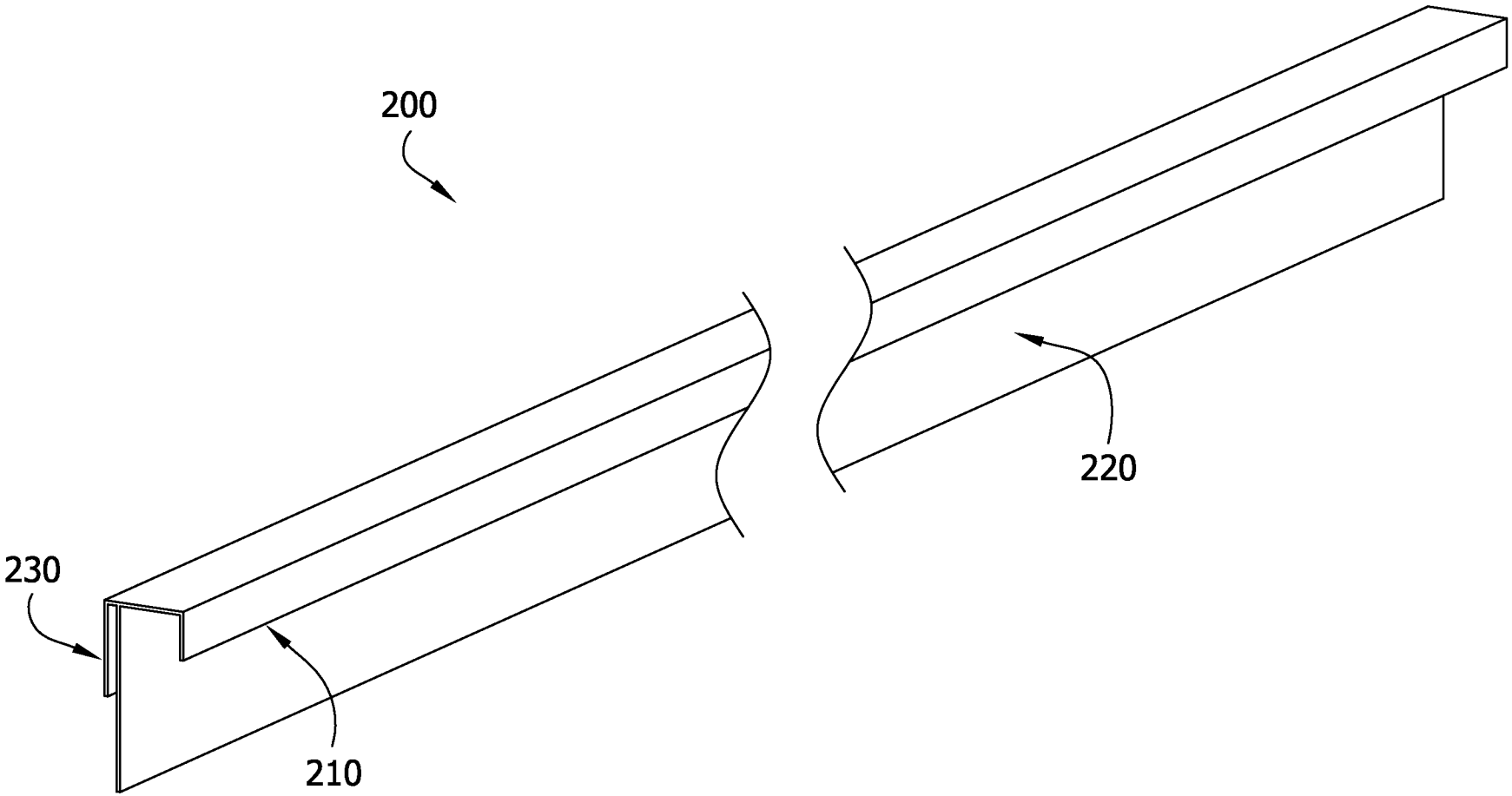
FIG. 7 is a fragmentary perspective of a blocker of another embodiment.
Figure 8:
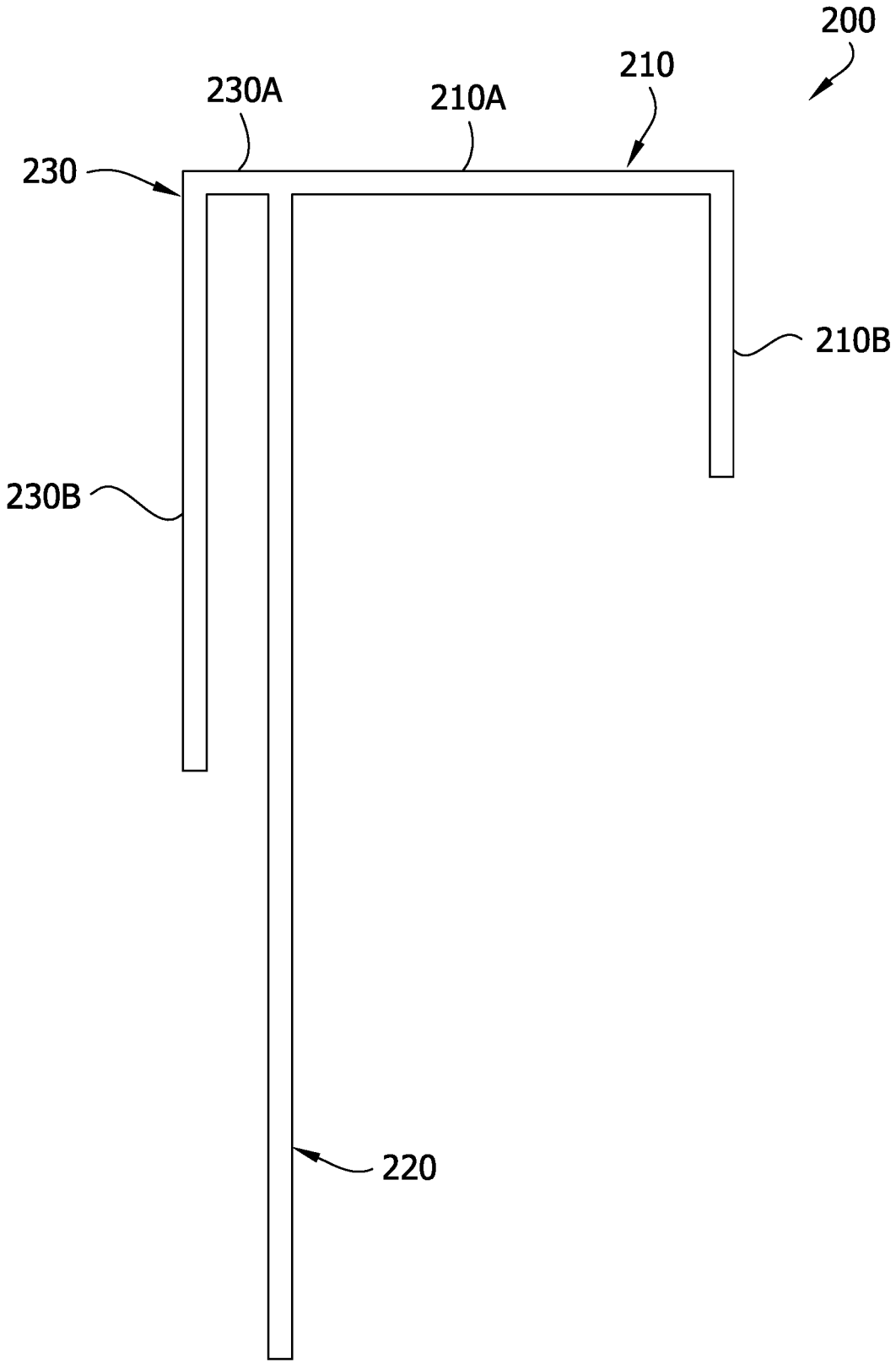
FIG. 8 is an enlarged end view of the blocker of FIG. 7.

Referring now to FIGS. 7 and 8 a blocker 200 of another embodiment is shown. Corresponding parts of the blocker 200 will be given the same reference numerals as for the blocker 100, plus "100". The blocker includes a cap portion 210, a tile engagement portion 220, and a clip portion 230. The tile engagement portion 220 has a first end and a second end. The cap portion 210 and clip portion 230 are both generally L-shaped, with each of the cap portion and the clip portion having a first segment and a second segment. The first segment 230A of the clip portion 230 is attached to the first end of the tile engagement portion 220. The second segment 230B of the clip portion projects in a direction from the first end of the tile engagement portion 220 toward the second end of the tile engagement portion and is generally parallel with the tile engagement portion. The first segment 210A of the cap portion 210 is attached to the first end of the tile engagement portion 220, and the second segment 210B of the cap portion 210 projects in a direction from the first end of the tile engagement portion toward the second end of the tile engagement portion and is generally parallel to the tile engagement portion. As applied to the drainage tile 10, the upper edge margin of the wall section 30A would be received between the second segment 230B of the clip portion 230 and the tile engagement portion 220. The first segment 210A of the cap portion 210 would span between the foundation wall 14 and the wall member 30 of the tile 10 to block a gap that could otherwise exist between the two.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions without departing from the scope of the invention, it is intended that all matter contained in the above description and shown in the accompanying drawings shall be interpreted as illustrative and not in a limiting sense.

What is claimed is:

1. A drainage tile system comprising:

a drainage tile including a wall member having a footing section configured to rest on a footing of a foundation and to permit water to flow along the footing, and a wall member configured to face a foundation wall in at least partially spaced relation with the foundation wall thereby defining a gap between the foundation wall and the wall member;

a blocker configured to attach to the wall member and to cover the gap between the wall member and the foundation wall, the blocker comprising a cap portion positioned so that when the blocker is attached to the wall member resting on the footing of the foundation, the cap portion projects from the wall member to the foundation wall to substantially close a gap between the wall member and the foundation wall, the cap portion including a first segment extending outward away from the foundation wall when the blocker is attached to the wall member resting on the footing of the foundation, and a second segment projecting downward from the first segment, the blocker further comprising a tile engagement portion projecting downward away from the first segment of the cap portion, and a clip portion projecting downward away from the first segment of the cap portion, the tile engagement portion and the clip portion bounding a space sized and shaped for receiving the wall member of the drainage tile.

2. The drainage tile system as set forth in claim 1 wherein the drainage tile comprises channels projecting from the wall member configured to face and engage the foundation wall to define the gap.

3. The drainage tile system as set forth in claim 2 wherein at least some of the channels are located a closest distance from a free edge margin of the wall member, the blocker being configured to attach to the wall member in a portion of the free edge margin between the channels spaced closest to the free edge margin and a free edge of the free edge margin.

4. The drainage tile system as set forth in claim 1 wherein the clip portion comprises an angled segment forming a free end of the clip portion.

5. The drainage tile system as set forth in claim 4 wherein the angled segment of the clip portion extends away from the tile engagement portion toward the free end of the clip portion.

6. The drainage tile system as set forth in claim 1 wherein the second segment of the cap portion is configured to extend parallel to and in engagement with the foundation wall when the drainage tile system is installed on the footing of the foundation.

7. A blocker for use on drainage tile applied to a footing of a foundation to permit water to flow along the footing, the drainage tile including a wall member configured to face a foundation wall in at least partially spaced relation with the foundation wall thereby defining a gap between the foundation wall and the wall member, the blocker comprising a connection portion configured to attach to the wall member and a cap portion projecting from the connection portion and positioned so that when the blocker is attached to the wall member resting on the footing of the foundation, the cap portion projects from the wall member to the foundation wall, the cap portion including a first segment extending outward away from the foundation wall when the blocker is attached to the wall member resting on the footing of the foundation, and a second segment projecting downward away from the first segment, the blocker further comprising a tile engagement portion projecting downward away from the first segment of the cap portion, and a clip portion projecting downward away from the first segment of the cap portion, the tile engagement portion and the clip portion bounding a space sized and shaped for receiving the wall member of the drainage tile.

8. The blocker as set forth in claim 7 wherein the clip portion comprises an angled segment forming a free end of the clip portion.

9. The blocker as set forth in claim 8 wherein the angled segment of the clip portion extends away from the tile engagement portion toward the free end of the clip portion.

10. The blocker as set forth in claim 7 wherein the second segment of the cap portion is configured to extend parallel to and in engagement with the foundation wall when the drainage tile system is installed on the footing of the foundation.

11. A blocker for use on drainage tile applied to a footing of a foundation to permit water to flow along the footing, the drainage tile including a wall member configured to face a foundation wall in at least partially spaced relation with the foundation wall thereby defining a gap between the foundation wall and the wall member, the blocker comprising a connection portion configured to attach to the wall member and a cap portion projecting from the connection portion and positioned so that when the blocker is attached to the wall member resting on the footing of the foundation, the cap portion projects from the wall member to the foundation wall to substantially close the gap between the wall member and the foundation wall, the connection portion including a clip portion and a tile engagement portion configured to receive an edge margin of the wall member therebetween for connecting the blocker to the drainage tile, the clip portion comprising an angled segment forming a free end of the clip portion, the angled segment of the clip portion extending away from the tile engagement portion toward the free end of the clip portion.

12. The blocker as set forth in claim 11 wherein the angled segment of the clip portion is skew in relation to the tile engagement portion.

13. The blocker as set forth in claim 11 wherein the cap portion includes a first segment and a second segment, the second segment of the cap portion being configured to extend parallel to and in engagement with the foundation wall when the drainage tile is applied to the footing of the foundation.

* * * * *